United States Patent [19]

Halvorsen

[11] Patent Number: 4,659,095

[45] Date of Patent: Apr. 21, 1987

[54] ROLLER SKATE ARRANGEMENT

[76] Inventor: Hjalmar S. Halvorsen, Welhavensgt. 13, N-5000 Bergen, Norway

[21] Appl. No.: 777,782

[22] PCT Filed: Jan. 24, 1985

[86] PCT No.: PCT/NO85/00005

§ 371 Date: Sep. 17, 1985

§ 102(e) Date: Sep. 17, 1985

[87] PCT Pub. No.: WO85/03644

PCT Pub. Date: Aug. 29, 1985

[30] Foreign Application Priority Data

Feb. 21, 1984 [NO] Norway ..... 840636

[51] Int. Cl.[4] ..... A63C 17/02

[52] U.S. Cl. ..... 280/11.27

[58] Field of Search ..... 280/11.23, 11.27, 11.28, 280/11.19, 112 A

[56] References Cited

U.S. PATENT DOCUMENTS

| | | | |
|---|---|---|---|
| 208,508 | 10/1878 | Bowen | 280/11.27 |
| 304,014 | 8/1884 | Lincoln | 280/11.27 |
| 4,125,268 | 1/1978 | Varner et al. | 280/11.28 |
| 4,159,128 | 8/1979 | Blaine | 280/112 A |

FOREIGN PATENT DOCUMENTS

| | | |
|---|---|---|
| 705040 | 3/1941 | Fed. Rep. of Germany . |
| 2029676 | 10/1971 | Fed. Rep. of Germany . |
| 2407010 | 5/1979 | France . |
| 90091 | 8/1937 | Sweden . |
| 446984 | 3/1968 | Switzerland . |
| 2549 | of 1875 | United Kingdom . |

*Primary Examiner*—John J. Love
*Assistant Examiner*—Richard M. Lamby
*Attorney, Agent, or Firm*—Kenyon & Kenyon

[57] ABSTRACT

A roller skate arrangement, which comprises a rigid sole portion (12) to which there is secured on the top side of a shoe upper portion (11) and on the under side a forward and rear wheel pair or wheel bogies (23*a*, 26*a*). The wheels (23*a*, 26*a*) of each wheel pair can be adjusted to different distances from the sole portion (12) in order to permit oblique positioning of the sole portion (12) sideways relative to the road surface. The wheels (23*a*, 26*a*) of the rear wheel pair are pivotable about a first pivotal axis (17*a*) at right angles to the main plane of the sole portion (12), while the wheels of the forward wheel pair are pivotable about a second pivotal axis at right angles to the main plane of the sole portion. Control means (35, 36; 37, 38; 39, 40) which are arranged between the sole portion (12) and the respective wheel pair, ensures positive control of the turning of at least the one wheel pair about the associated pivotal axis relative to the sole portion, preferably positive control of the turning of the rear wheel pair about the first pivotal axis (17*a*) relative to the sole portion and sectional positive control of the turning of the forward wheel pair about the second pivotal axis (18*a*) relative to the sole portion.

5 Claims, 5 Drawing Figures

ROLLER SKATE ARRANGEMENT

The present invention relates to a roller skate arrangement, comprising a rigid sole portion to which a shoe upper portion is secured on the top side and on the under side a forward and a rear pair of wheels or wheel bogies The skates is such that the sole portion is pivotable sideways about a longitudinal roller skate axis relative to the plane of the road base.

Roller skates are known of various constructions. Usually roller skates are designed with a rigid and immovable connection between the wheels and the user's footwear or the footwear secured to the roller skate. The wheels of the roller skate are locked in a direction which approximately coincides with the longitudinal direction of the roller skate. As a consequence of the rigid and immovable connection between footwear and wheels, a somewhat unnatural foot position and unnatural use of the muscles occurs. Compared with using conventional skates on an ice surface, one has far less control of a roller skate and the possibility for far less steering.

German O.S. No. 2029676 describes a roller skate where the sole portion is pivotable about a longitudinal roller skate axis relative to the road base and relative to the rotation axes of each wheel pair. By such a known solution a certain, but nevertheless rather limited movability of the foot with associated sole portion relative to the wheels of the roller skate is achieved. The oblique positioning of foot and sole portion is dependent on the counter force from a press spring or the like.

With the present invention the aim is a solution with which one can obtain a far better control of the movement possibilities of the roller skate.

U.S. Pat. No. 3,389,922 describes a roller ski with a forward wheel and a rear wheel where the rotary shaft of the wheels is pivotable relative to the wheel hub, which is provided with a substantially elliptical or oval groove for limited revolving of the rotary shaft in this. By this there is the possibility for effecting a turning of the wheels relative to their rotary shafts by obliquely positioning the roller ski sideways.

With the relatively small wheels (small wheel diameter) which is employed in a roller skate such a known solution for turning of roller skis will give the possibility for minimum pivoting of the roller skate, and in addition the control of the pivotal movement becomes rather arbitrary and can easily produce undesired sudden turns as a consequence of the insufficient possibility for control.

The arrangement according to the invention is characterised in that the rotation axis of each wheel in each wheel pair can be pivoted individually relative to the plane of the road base, decided by the turning of the sole portion relative to the plane of the road base, the turning of the rotation axis of each wheel relative to the plane of the road base being positively controlled via connecting members from the sole portion, and that the wheels of the rear wheel pair are pivotable about a first pivotal axis running at right angles to the main plane of the sole portion and the wheels of the forward wheel pair are correspondingly pivotable about a second pivotal axis at right angles to the main plane of the sole portion, the turning of each wheel pair about its pivotal axis being positively controlled via control means from the sole portion, preferably with a more limited pivoting possibility of the forward wheel pair than of the rear wheel pair.

According to the invention an accurately controllable turning possibility of the roller skate is achieved by permitting turning about a vertical axis of each wheel pair and in addition a turning possibility of the axis of each wheel individually relative to the base. A positive control is provided between the different pivotable portions, so that for a particular oblique position of the foot there is a particular turning of the wheel pairs about the axis at right angles to the sole portion and a particular oblique position of the rotation axis of each wheel, respectively. It is hereby possible for the user of the roller skate to make a turning in an exactly controlled manner by oblique positioning of the foot and the sole portion relative to the rest of the skate. At the same time one has the possibility for adjusting the rotation axis of the wheels parallel to the plane of the sole independent of the turning of the wheel pairs relative to each other.

Further features of the roller skate according to the invention will be evident from the following description with reference to the accompanying drawings, where there is shown a preferred embodiment and in which.

Figure 1:
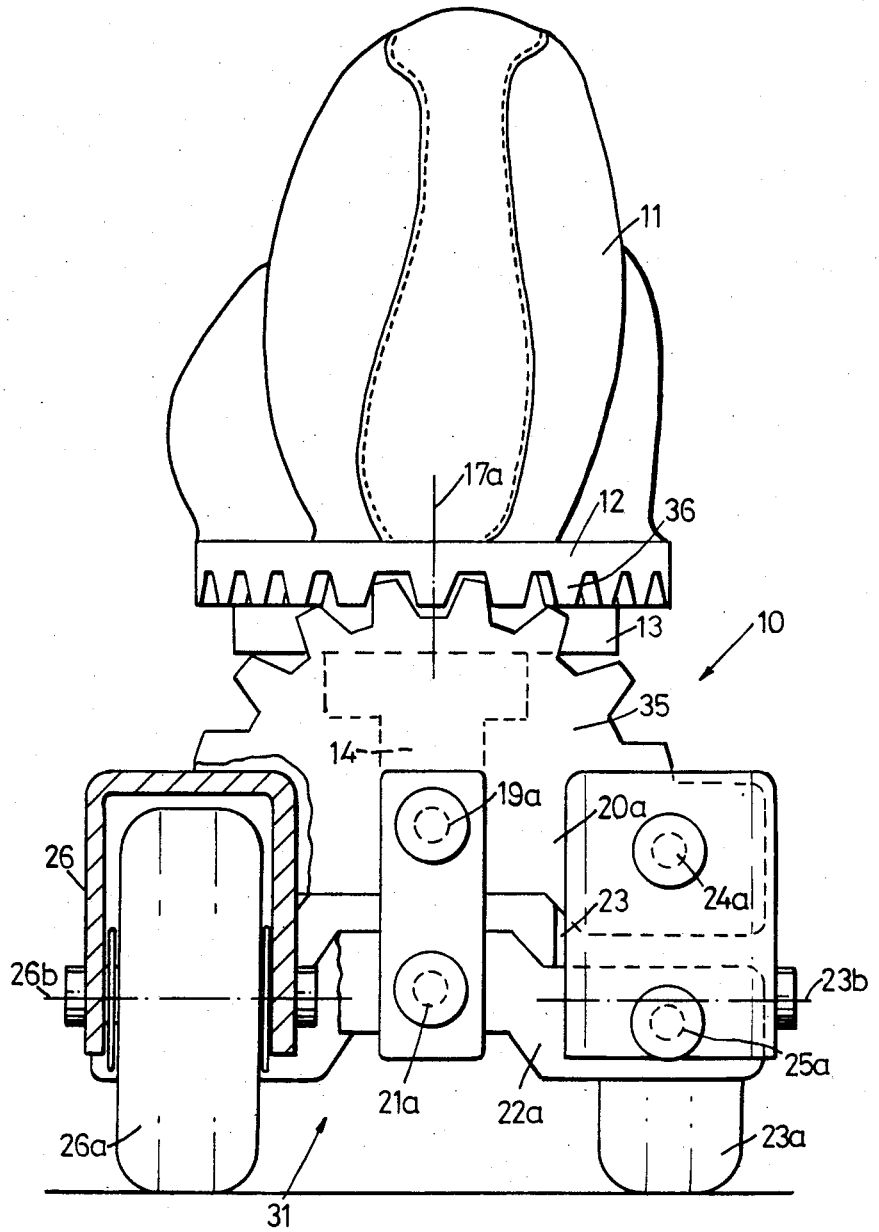
FIG. 1 shows the roller skate seen from the front.
Figure 2:
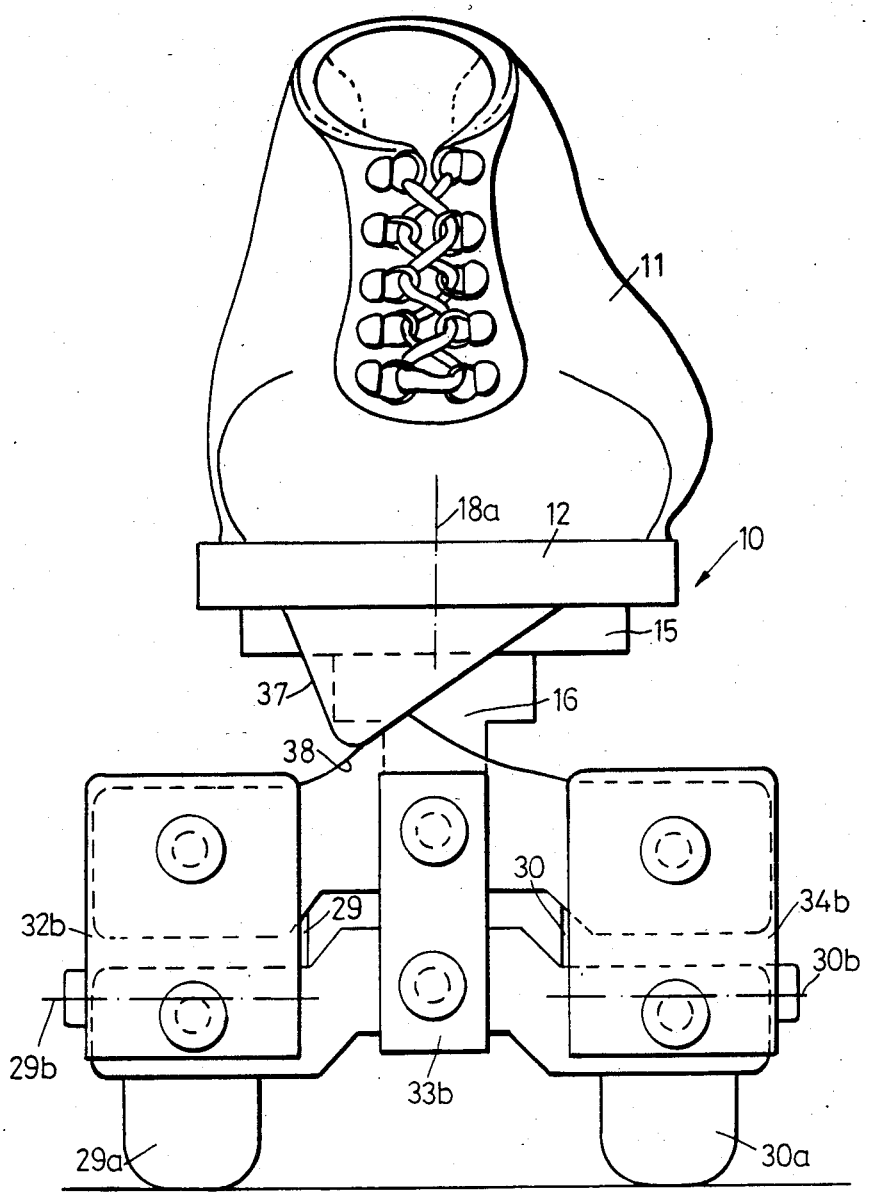
FIG. 2 shows the roller skate seen from the rear.
Figure 4:
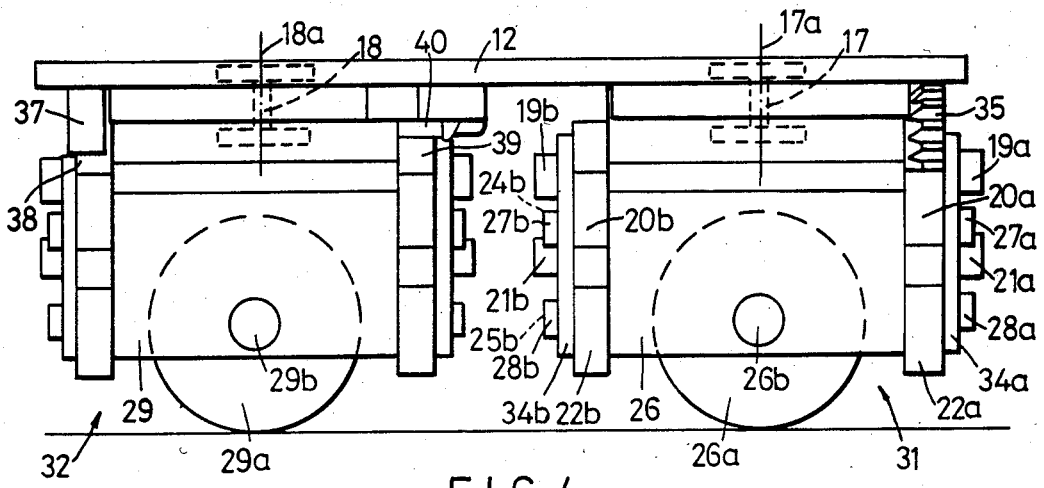
FIG. 4 shows the roller skate seen from the side.
Figure 5:
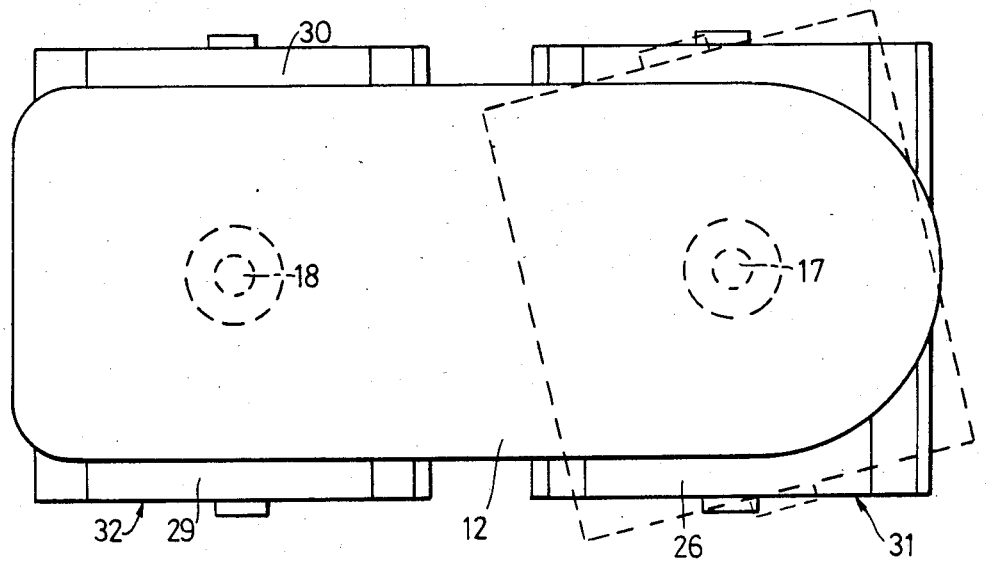
FIG. 5 shows portions of the roller skate seen from above.

As illustrated in FIGS. 1 and 2 a roller skate 10 is provided with a shoe upper portion 11 with a rigid sole portion 12 which at the rear rests on a first rotary plate 13 on an associated stem member 14 and which at the front rests on a second rotary plate 15 on an associated stem member 16. The rotary plate 13 with the stem member 14 is rotatably mounted about a substantially vertical axis 17*a* about a pivot pin (FIG. 4), while the rotary plate 15 with the stem member 16 is correspondingly rotatably mounted about a substantially vertical axis 18*a* about a pivot pin 18 (FIG. 4).

At opposite ends of the stem member 14 an upper, two-branched rear pivot arm 20*a* and an upper, two-branched forward pivot arm 20*b* are pivotably mounted about a first and second, upper horizontal pivot pin 19*a* and 19*b* respectively, and a lower two-branched rear pivot arm 22*a* and a lower, two-branched forward pivot arm 22*b* are pivotably mounted about a first and second, lower horizontal pivot pin 21*a* and 21*b* respectively. A first wheel holder 23 is pivotably mounted about an upper horizontal pivot pin 24*a* at the one end of the pivot arm 20*a* and about an upper horizontal pivot pin 24*b* at the one end of the pivot arm 20*b* and about a lower pivot pin 25*a* at the one end of the pivot arm 22*a* and about a lower pivot pin 25*b* at the one end of the pivot arm 22*b*. A second wheel holder 26 is correspondingly suspended about pivot pins 27*a*, 27*b* at the other end of the pivot arms 20*a* and 20*b* and about pivot pins 28*a*, 28*b* at the other end of the pivot arms 22*a*, 22*b*. The wheel holders 23 and 26 each support their respective wheel 23*a* and 26*a* rotatably mounted about the pivotal axis 23*b* and 26*b*.

In a corresponding manner as explained above two wheel holders 29, 30 are pivotably suspended to the stem member 16 which each support their associated wheel 29*a* and 30*a* rotatably mounted about pivotal axes 29*b* and 30*b*.

The roller skate is thus provided with two longitudinally separate wheel bogies 31, 32 each with their two laterally displaced wheel holders 23, 26 and 29, 30 which give the roller skate the stability in the longitudinal direction and the side direction. The wheel bogies are separately pivotably suspended about the vertical pivotal axes 17*a* and 18*a*, while the wheels of each bogie can be moved in turn towards and away from the sole of the footwear by means of the parallelogram link-forming pivot arm system 20*a*, 22*a* and 20*b*, 22*b*. The pivot arms 20*a*, 22*a*, and 20*b*, 22*b* are respectively connected to each other via short link arms 32*a*, 33*a*, 34*a* and 32*b*, 33*b*, 34*b*.

Figure 3:
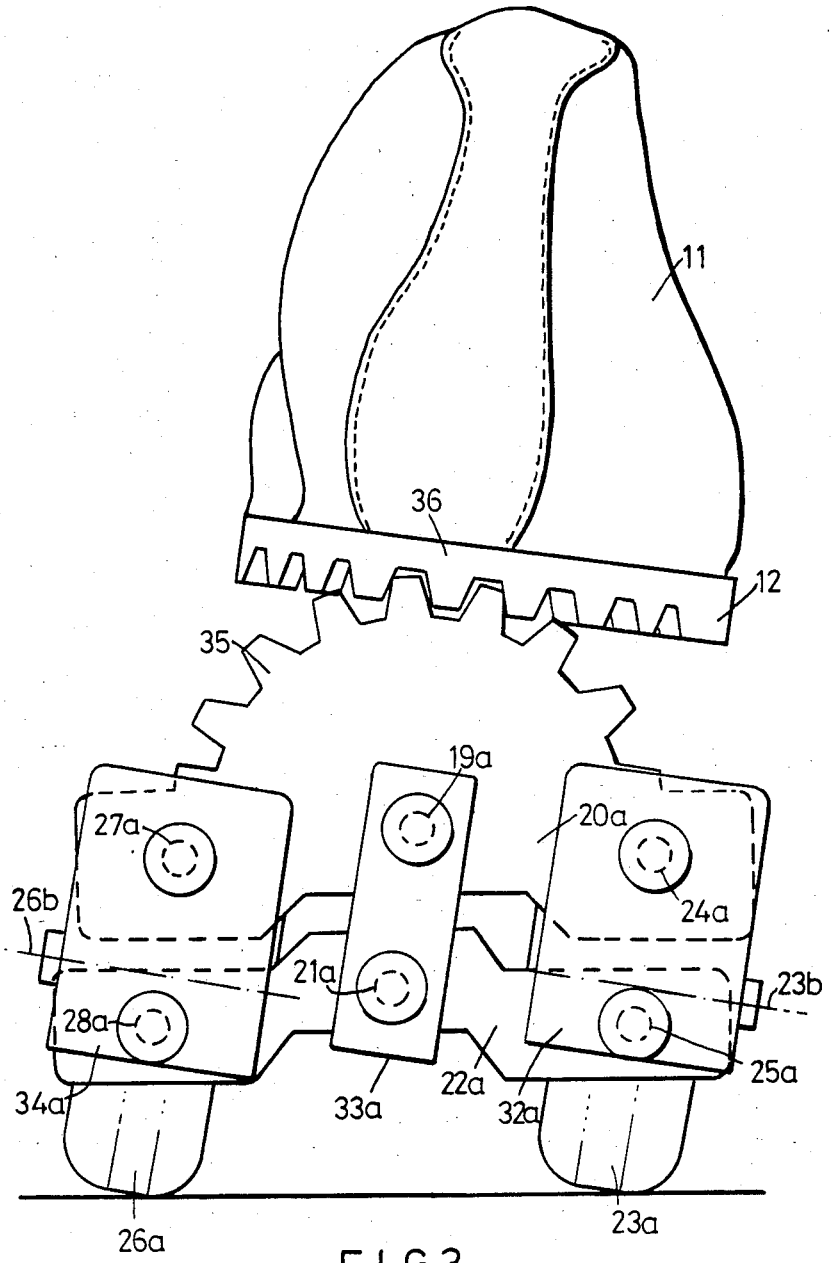
FIG. 3 shows the roller skate in a turned position.

A control means is provided to obtain a controlled movement of the wheel bogies when these are to be swung about the axes 17*a* and 18*a* provision is made for a positive control of the pivotal movement. In this connection the rear wheel bogie 31 is equipped with a gear wheel 35 which is engaged to a gear wheel 36 of the sole portion 12 of the footwear, as is shown in FIGS. 1, 3 and 4. The toothed wheel 35 is secured to the upper rear pivot arm 20*a*, so that turning of the pivot arms of the wheel bogie 31 relative to the stem member 14, as is indicated in FIG. 3, will cause a corresponding rotation of the bogie 31 about its vertical axis 17*a* produced by the rolling between the teeth on the toothed wheels 35 and 36.

In order to ensure a corresponding positive control of the forward bogie, the sole portion is provided with a support member 37 which bears against and which can be rolled along a cam guide 38 on the forward, upper pivot arm of the bogie 32. On the rear, upper pivot arm (not shown further) there can be arranged a toothed gear wheel 39 with some few teeth which engage a corresponding toothed gear wheel 30 on the sole portion. In the illustrated embodiment, provision is made for the one bogie 32 to move relatively freely and unhindered over a certain pivotal arc on the one side and only positively controlled over a lesser pivotal angle about a vertical position, and positively controlled over a smaller pivotal angle on the other side. In this way there is the possibility for adapting the pivotal movement of the wheel bogie 32 to a certain degree relative to the complete positive pivotal movement of the wheel bogie 31 by pressure loading on the inner skate and outer skate respectively. By way of stop means (not shown) further placed between the sole portion and the rotary plate, provision can be made for limiting the possibilities for pivoting of the bogies about their vertical axes.

I claim:

1. A roller skate comprising a sole portion;

a pair of bogies supporting said sole portion; each bogie being pivotally mounted about a vertical axis passing through said sole portion, each bogie including a pair of holders, a wheel rotatably mounted in each respective holder about a horizontal axis and a parallelogram pivot arm system connecting said pair of holders to permit lateral tilting of each holder and said wheel therein; and control means for controlling pivoting movement of at least a rear one of said wheel bogies, said control means including a first gear wheel secured to said sole portion and a second gear wheel secured to said pivot arm system of said rear bogie and disposed in meshing engagement with said first gear wheel whereby tilting of said sole portion causes tilting of each wheel of said rear bogie and pivoting of said rear bogie about said vertical axis thereof.

2. A roller skate as set forth in claim 1 wherein said sole portion is pivotal about a longitudinal horizontal axis.

3. A roller skate as set forth in claim 1 which further comprises a support member secured to said sole portion and a cam guide on the forward one of said bogies contacting said support member for controlling pivoting of said forward bogie.

4. A roller skate as set forth in claim 1 which includes a vertical stem securing one of said bogies to said sole portion for rotation about a vertical axis.

5. A roller skate as set forth in claim 4 wherein said parallelogram pivot arm system includes a pair of vertically spaced horizontal arms at each end of a pair of holders of a respective bogie, each arm being pivotally connected to a respective holder on a horizontal axis and being pivotally connected to said stem at an intermediate point.

* * * * *